United States Patent [19]

Hagen

[11] 3,934,291

[45] Jan. 27, 1976

[54] WATER SPORTS WHEEL

[75] Inventor: Frederic Hagen, New York, N.Y.

[73] Assignee: Douglas Leigh Research and Development Corporation, New York, N.Y.

[22] Filed: Aug. 23, 1974

[21] Appl. No.: 500,041

[52] U.S. Cl. ..... 9/310 G; 115/20; 272/1 B; 272/57 T

[51] Int. Cl.[2] ..... A63C 15/04

[58] Field of Search ..... 9/310 G, 310 R, 2 A; 114/61; 115/20; 272/1 B, 57 T

[56] References Cited

UNITED STATES PATENTS

| | | | |
|---|---|---|---|
| 2,468,287 | 4/1949 | Bohler | 9/2 A |
| 2,838,022 | 6/1958 | Wilson | 9/310 G |
| 3,088,732 | 5/1963 | Hetland | 9/310 G |
| 3,608,112 | 5/1969 | Irgens | 9/2 A |
| 3,675,259 | 7/1972 | Gilchrist | 9/310 G |

FOREIGN PATENTS OR APPLICATIONS

| | | | |
|---|---|---|---|
| 500,989 | 2/1939 | United Kingdom | 9/310 R |
| 682,951 | 10/1939 | Germany | 9/310 G |

*Primary Examiner*—Trygve M. Blix
*Assistant Examiner*—Charles E. Frankfort

[57] ABSTRACT

A unitary hollow paddle wheel of a size to receive a person in upright position and composed of two circular pneumatic tubes connected in spaced relation by transverse members that also support a tread which is operated by the person within the wheel to propel the same in a forward or backward direction and through which the person may observe his progress.

1 Claim, 7 Drawing Figures

WATER SPORTS WHEEL

THE INVENTION

This invention relates to a water craft in the form of a wheel built to receive a person and enabling the latter by a running or walking motion to move the wheel forwardly or rearwardly, or to cause it to turn to the right or left as desired.

The primary object of the invention is to provide a novel sports wheel which will permit a person to travel on water at varied speeds and in selected directions and at the same time get the feel of the body of water on which he is traveling.

Other objects of the invention, as well as the advantages and features of novelty thereof will become apparent from a perusal of the following description, when read in connection with the accompanying drawings, in which.

Figure 1:
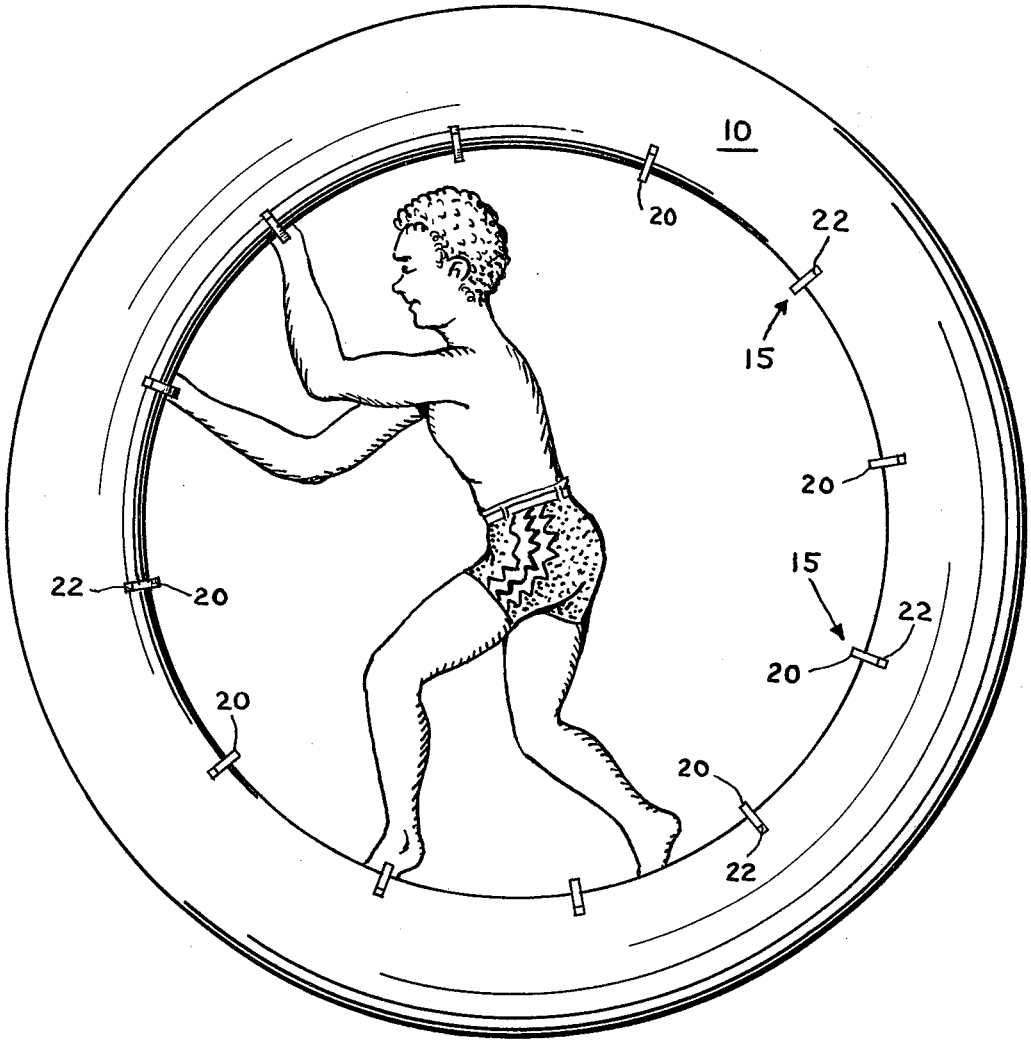
FIG. 1 is a side elevational view of a waterwheel embodying the invention and indicates how it may be operated by a sportsman.

In the drawings, the numerals 10,11 designate the two circular tubular members which provide the waterwheel with its floating capability. The tubes are of sufficient diameter, say of the order of ninety inches to enable a person to freely enter either side of the waterwheel and to run or walk within the wheel without coming into interference with the wheel structure while doing so. The tubes 10 and 11 may be made of any suitable material and are preferably inflatable and made of a flexible, resilient material such as a known plastic or rubber substance. Each of the tubes 10 and 11 define a closed, circular pocket within which is contained air or any suitable gas under a given pressure to provide the wheel with the desired buoyancy. The pockets in the tubes 10 and 11 may be permanently sealed, or the tubes provided with suitable air valves of a known type to enable the tubes to be collapsed and the waterwheel disassembled at will. The tubes 10,11 are of sufficient width, such as about one foot, and are sufficiently spaced apart, say of the order of four feet, to provide the stability needed for varied manipulation of the wheel in the water without it toppling from its upright or operable position.

The two tubes 10 and 11 are connected together by a series of spaced, transversely extending holder members each of which is generally designated by the reference numerals 15. The holder members 15 are separate from each other and are made of any suitable rigid material such as metal, plastic, wood, etc. As will be observed in FIGS. 1 to 3 of the drawings, the holder members 15 are multi-purpose members and perform a plurality of functions. Thus, they (1) connect the tubes 10 and 11 to the wheel structure, (2) provide paddle blades 16 for propelling the wheel, (3) provide supports for the tread panels 17, (4) provide handles 18 for the sportsman operating the wheel, and (5) form openings 19 through which the sportsman can see where he is heading. As will be seen more clearly in FIGS. 2–5 of the drawings the holder members 15 extend across the space between the two tubes 10 and 11 and are each provided at their outer ends with arcuately-shaped portions 20,20 shaped to receive the tubes 10 and 11. The outer end 21 of each arcuate portion 20 extends from a point short of an outside radius of the associated tube and on the inner side of such tube so that the wheel may be rolled on land without interference by the holders 15. Each arcuate portion 20 extends from its outer end 21 inwardly around the associated tube for a distance slightly greater than 180° so that its inner end 22 terminates short of the outer side of the associated tube. The arcuate tube holding portions 20 of the holder members 15 therefore do not project beyond the sides of the tubes 10 and 11, but provide sufficient seating area to enable them to securely hold or grip the two tubes. Preferably the diameter of the inner seating surfaces of the arcuate portions 20 is less than the diameter of the tubes in their expanded condition so that such portions exert a gripping action on the tubes in the latters inflated condition.

Integral with and extending between the two end arcuate portions 20 of each holder member 15 is a transverse bar-like portion 23, the inner edge of which is substantially in alignment with associated cross-sectional horizontal diameters of the two tubes, and the central portion of which provides a handle 18. Extending outwardly from the end portions of the bar portion 23 and integral with the latter are two paddle blades 16,16 spaced by the handle 18 thereof. The blades 16 project out as far as the outer ends 21 of the associated arcuate portions 20 and are integral with such outer ends 21. Thus the paddle blades 16 are rigidified by the arcuate portions 20 and in turn rigidify the outer ends 21 of the latter. The inner end portions of the blades 16 incline inwardly toward the handle 18 of the holder 15. As a result of its configuration, each blade 16 has a mean length of approximately two and one-half feet. On the inner side of each blade 16, the associated arcuate portion 20 gradually enlarges from its inner end portion and such enlarged section 24 of the arcuate portion 20 is integral with the blade 16 and the associated outer end of the bar portion 23 and affords a strong connection between the three holder parts 16, 20 and 23.

Figure 2:
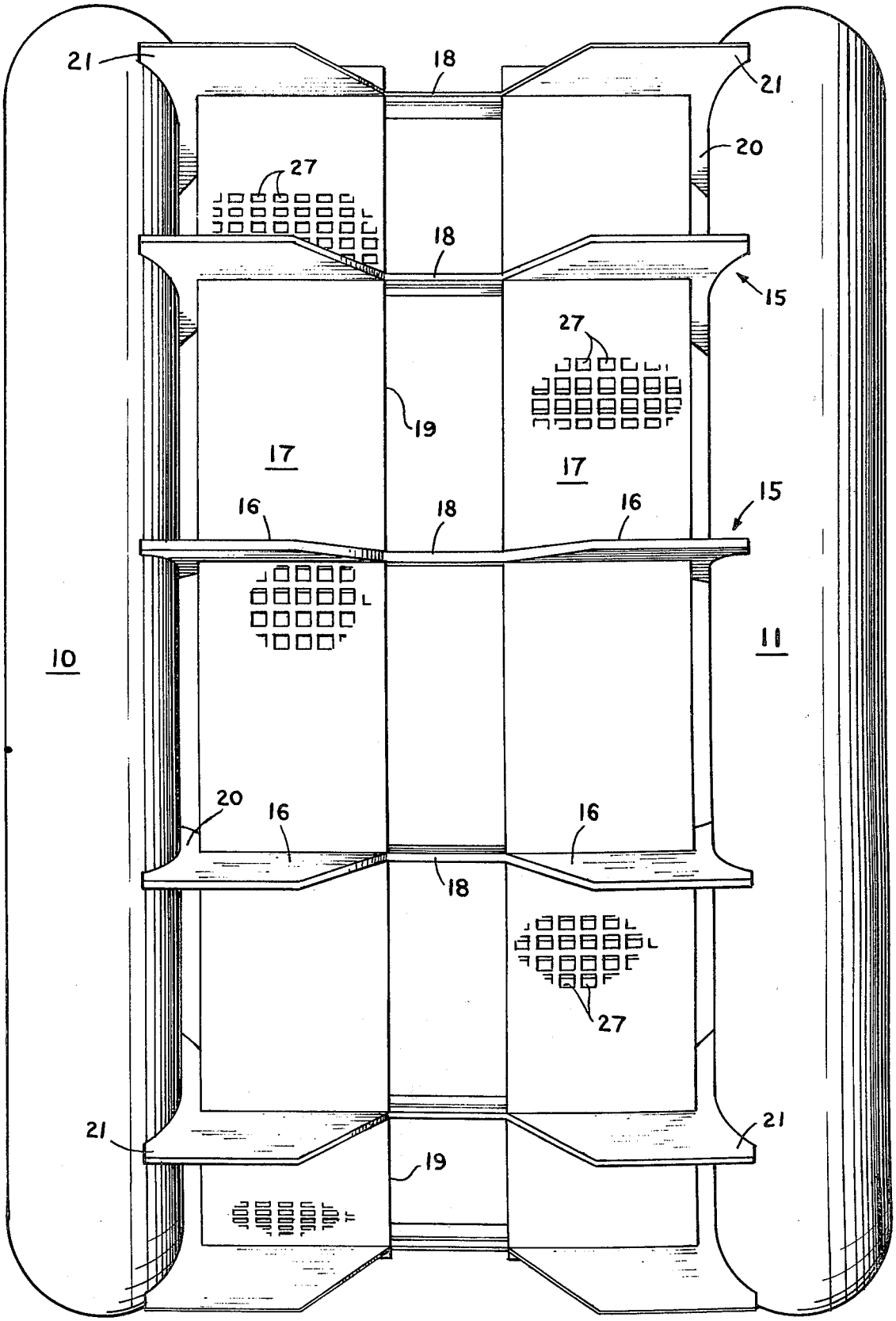
FIG. 2 is an enlarged front elevational view of the waterwheel shown in FIG. 1.
Figure 3:
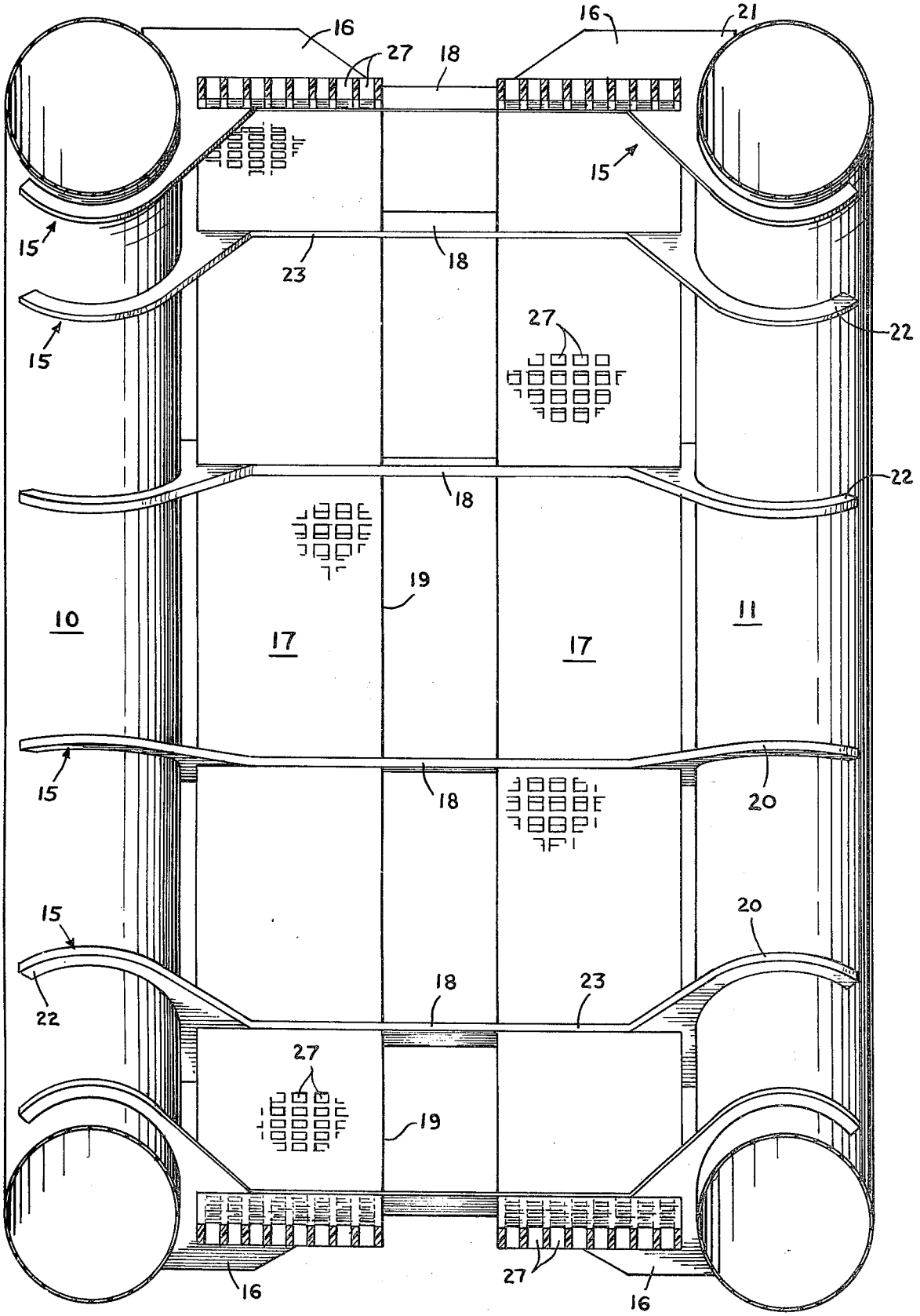
FIG. 3 is a central, front elevational, vertical sectional view of the waterwheel shown in FIG. 2.
Figure 4:
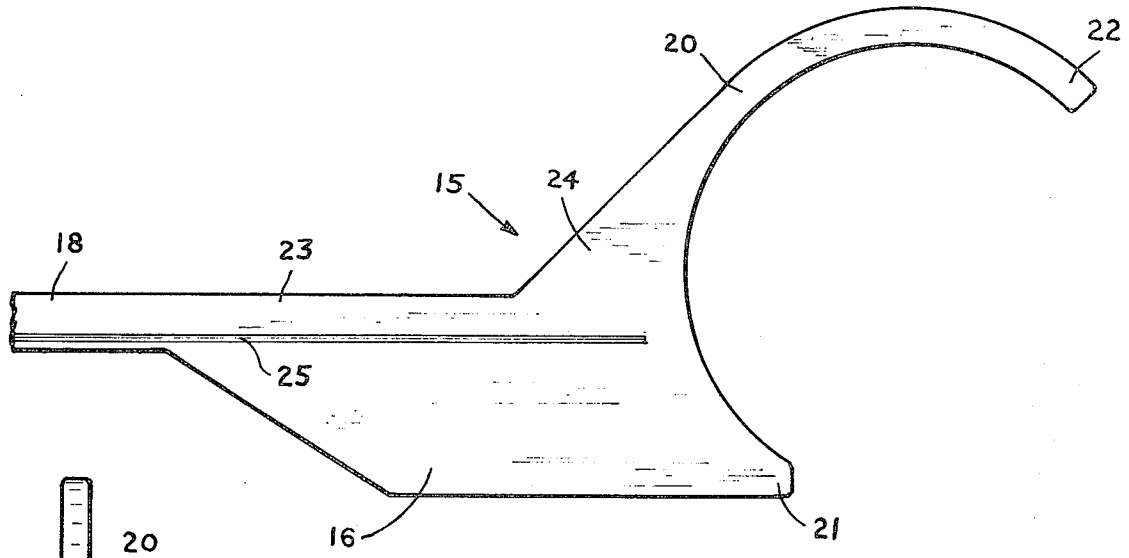
FIG. 4 is an enlarged partial elevational view showing one end of one of the tube and tread connecting members on the waterwheel.
Figure 5:
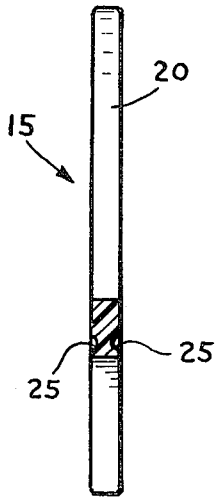
FIG. 5 is an end elevational view of the part shown in FIG. 4.
Figure 6:
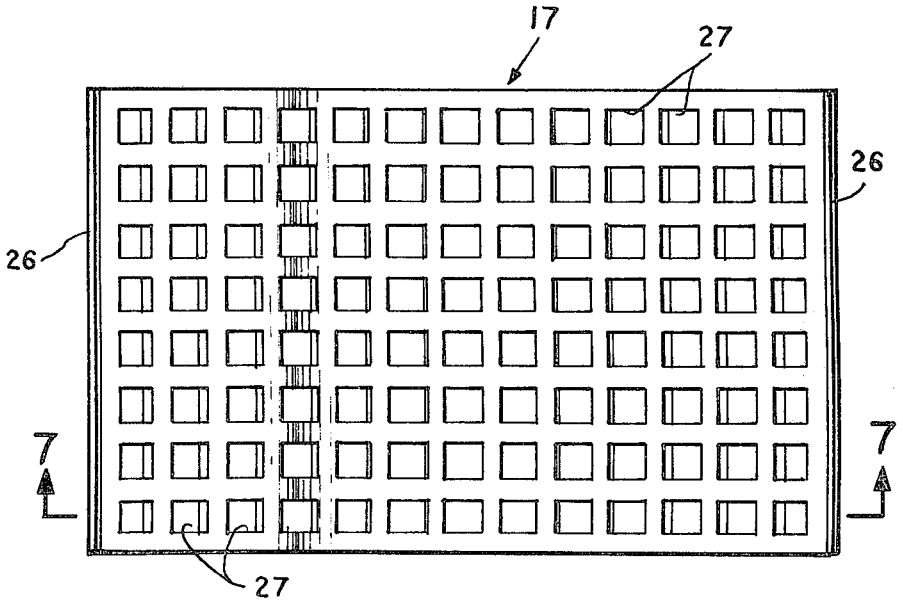
FIG. 6 is a top plan view on an enlarged scale of one of the tread members.
Figure 7:
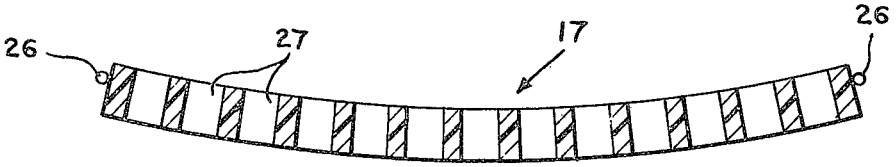
FIG. 7 is a sectional view taken along the line 7—7 of FIG. 6.

As will be observed more readily in FIGS. 2 and 3 of the drawings, the adjacent holder members 15 are spaced by the tread panels 17 which are connected together by the means shown in FIGS. 4–7 of the drawings. Each bar portion 23 of the holder member 15 is provided on both sides with slots 25 configured cross-sectionally to receive with a snap fit beads 26 provided on the end edges of the tread panels 17. The tread panels 17 may be made of any suitable material and may be made of the same or of a different material than that of the holder members 15. The tread panels 17 are each arcuately shaped in the circumferential direction of the wheel and are approximately three feet wide and five feet long to afford adequate footing for the operator. Preferably also, the panels 17 are provided throughout their entire areas with openings 27 to provide ready drainage of water therefrom and to assure a secure footing for the operator.

It will be understood from the above description of the waterwheel of this invention, that the parts thereof can be readily assembled without the use of tools and when assembled will provide a sturdy wheel construction capable of enduring the stresses it will undergo during its operation on a water mass. All that is necessary in the assembly of the parts thereof is to initially space the holder members 15 on the two tubes 10, 11 which have been initially partially inflated, and then progressively connecting the beaded ends of the tread panels 17 to the grooves 25 in the holder members 15. The tread panels 17 are all of equal size and so dimensioned with respect to the tubes 10, 11, that when they have been properly assembled the holder members 15 will be equally spaced about the tubes. When the holders 15 and tread panels 17 have been assembled on the tubes 10 and 11, the latter are provided with additional air pressure sufficient to lock the arcuately-shaped portions 20 and consequently the holders 15 and the tread panels 17 to the tubes.

As indicated in FIG. 1 of the drawings, the waterwheel in usage floats in an upright position due to the buoyancy of the two tubes 10 and 11. Because the two tubes are relatively large and boardly spaced, the wheel is relatively steady in its upright position. The wheel is propelled by the operator walking or running on the tread panels 17 to cause the wheel to revolve in one direction or the other. This rotatable movement of the wheel is translated into a linear motion on the water mass by the paddles 16 which engage the water and push the wheel in the direction it is rotating. The operator preferably grips the handles 18 while he is walking or running to steady him in his movements and to enable him to tilt the wheel so that he can move toward the left or right as he desires. By reason of the spaces 19 between the two series of tread panels 17 and the fact that the sides of the wheel are open, the operator can observe at all times his position and where he is headed. Due to the open character of the waterwheel and the fact that as it revolves the paddles and treads will be lifting water, the operator will get the feel and sound of the water in which he is operating and will be maintained cooled as though he were swimming. It will be apparent that an active operator can create many types of maneuvers for his amusement and that the wheel provides an attractive competitive device.

While I have described and illustrated a preferred embodiment of my invention, it will be apparent to those skilled in the art, that various changes may be made therein without departing from the spirit of the invention, or the scope of the appended claims.

I claim:

1. A manually operable water craft, comprising a pair of circular pneumatic tubes made of flexible, resilient material and arranged in spaced side-by-side upright relation for rotary motion on the surface of a water mass and forming two closed circular pockets for a gas providing the craft with the desired buoyancy in the upright rotatable positions of said tubes, a plurality of diametrically spaced and transversely extending holding members located between and connecting said circular tubes in spaced side-by-side relation, said transverse holding members being formed at both outer ends to provide tube gripping means each enclosing in gripping relation the inner wall portion of a tube, the central portions of said holding members being configured to provide centrally of the craft diametrically spaced hand grips for the operator, and said holding members between said outer tube gripping means and said central portions thereof being each configured to form two outwardly projecting spaced paddles, the paddles of said holding members being aligned to form two spaced series of circumferentially spaced paddles adapted to convert rotary motion of the craft into linear motion on the water mass, a series of arcuately-shaped, perforated panels aligned with each series of paddles with the panels in each series thereof located between the paddles aligned therewith, and means connecting the ends of the panels in each series to said holding members at the root portions of the paddles with such panels to provide within the two series of paddles two circular treads on which an operator within the craft walks to cause rotation of said tubes, said two spaced aligned series of tread panels and paddles providing a central circular opening therebetween interrupted only by the central portions of said holding members extending across said opening to provide hand grips for the operator.

* * * * *